US006097830A

United States Patent [19]

Zelinka et al.

[11] Patent Number: 6,097,830

[45] Date of Patent: Aug. 1, 2000

[54] TRANSDUCER DIAPHRAGM WITH THERMAL STRAIN RELIEF

[75] Inventors: Thomas Richard Zelinka, Vancouver, Canada; F. Bruce Thigpen, Tallahassee, Fla.

[73] Assignee: Sonigistix Corporation, Vancouver, Canada

[21] Appl. No.: 08/971,342

[22] Filed: Nov. 17, 1997

[51] Int. Cl.[7] ..... H04R 25/00

[52] U.S. Cl. ..... 381/431; 381/408

[58] Field of Search ..... 381/431, 429, 381/426, 424, 423, 408, 399, 398, FOR 156, FOR 163

[56] References Cited

U.S. PATENT DOCUMENTS 3,209,084 9/1965 Gamzon .
3,898,598 8/1975 Asahi ..... 381/431
4,264,789 4/1981 Kaizu et al. .
4,281,223 7/1981 Ugaji et al. .

FOREIGN PATENT DOCUMENTS 2461258 7/1996 Germany ..... 381/FOR 156

*Primary Examiner*—Huyen Le
*Attorney, Agent, or Firm*—Dowell & Dowell, P.C.

[57] ABSTRACT

An acoustic transducer including a diaphragm having an electrical conductor applied thereto such that at least one segment of the conductor is selectively separable from the diaphragm in response to electric power being applied to the conductor to thereby provide thermal stress relief to the diaphragm during use.

20 Claims, 3 Drawing Sheets

TRANSDUCER DIAPHRAGM WITH THERMAL STRAIN RELIEF

BACKGROUND OF THE INVENTION

1. Field of the Invention

The present invention is directed to the field of acoustic transducers including magnetic acoustic transducers and, more particularly, to the treatment of conductor circuits associated with the diaphragms of magnetic acoustic transducers. The transducer diaphragm is mounted in proximity to magnets fixed to support frames such that when current flows in the conductor circuit the resulting electromotive forces vibrate the diaphragm with piston-like motion and accurately reproduce acoustic signals.

2. History of the Related Art

Magnetic acoustic transducers and particularly planar magnetic loudspeakers are generally popular because of their good sound reproduction characteristics. Such loudspeakers typically include a generally flat diaphragm having a pattern of one or more conductors attached which form the "voice coil" or signal current carrying conductors. The diaphragm is positioned so that the conductors are attracted and repelled by the magnets as current signals pass through the conductors, thereby causing the diaphragm to oscillate and produce sound.

The sound reproduction of a typical planar magnetic transducer is sensitive to the operating characteristics of the diaphragm. A typical planar diaphragm includes a thin flat polymer membrane with a pattern of thin foil-like conductors attached to the membrane. Aluminum is an optimum conductor material because of its light weight and low electrical impedance. To obtain optimum acoustic response, the diaphragm is held under in-plane tension generally in a plane parallel to the pole faces of one or more magnets. The path for the electrical conductor runs on the diaphragm is generally chosen so the current flowing through the conductors induces net forces of uniform direction for all of the conductor segments or runs within what is referenced as an "active area" of the diaphragm. The generated forces thereby cause the general direction of diaphragm motion to be perpendicular to the diaphragm surface during operation of the transducer. The "active area" of the diaphragm, as described and referenced throughout this application, both in the specifications and claims, is that area of the diaphragm which is not constrained from motion by the rigid frame which supports the diaphragm relative to the one or more magnets. The mechanical properties of the diaphragm and conductor pattern determines modal behavior patterns of the diaphragm, and hence its sound reproduction characteristics.

Heat is produced within the conductor pattern and can modify the acoustic output of the transducer when power is applied to the electrical conductor circuits from a conventional amplifier. The problem is more severe during operation of smaller planar magnetic transducers as the area of heat dissipation of the conductors is reduced. The sound reproduction characteristics of smaller planar magnetic speakers are also more sensitive to diaphragm tension. At increased electrical power, the aluminum conductor material expands at a much greater rate than the polymer diaphragm, which is typically made of MYLAR™. The resulting shear stress from differential thermal expansion between the two layers may result in non-uniform stresses across the diaphragm. The diaphragm tension may thus change over parts of the "active area" of the diaphragm and undesirable audible distortion may occur. As the size of a planar magnetic transducer is reduced, the heat buildup is greater for a given amount of input power because of the reduced surface area of the diaphragm. The heat buildup reduces the maximum usable power which may be delivered to the transducer. Increased audible distortion and reduced efficiency resulting from changes in the diaphragm tension have been observed in the past with smaller planar magnetic transducers. The changes in tension due to heating from increased electrical power through the conductor pattern are dependent on the materials, layout, and cross-section of the diaphragm structure. The non-uniform displacement also causes a non-piston like behavior of the diaphragm creating valleys and peaks in the frequency response of the loudspeaker. For example, local pockets may form in the diaphragm which move out of phase with respect to the pistonic motion of the rest of the diaphragm, resulting in distortion and loss of output.

Ideally, the behavior of the diaphragm is like a piston through the normal operating frequency range.

Diaphragm structures common in the art include circuits etched into adhesively-backed aluminum laminated to a polymer diaphragm, and circuits with conductive wire or strips adhesively bonded to a polymer diaphragm. For these diaphragms with an adhesive laminated between the conductor and polymer diaphragm, as the heating increases further, random sections of the conductor may start to delaminate in response to the thermal stress induced in the adhesive layer. The random delamination of the conductor produces sites of thermal stress relief. The location and size of these non-adhered sites are not controlled, resulting in variable acoustical response of the diaphragm. Also, damage to the underlying polymer film is possible, and large non-adhered areas typically form an arch which can limit full excursion of the diaphragm. Hence, uncontrolled separation of the conductor from the diaphragm due to heating stresses creates thermal stress relief sites of varying size and allows higher operating powers, but may reduce optimum sound reproduction quality due to increased distortion and limited diaphragm excursion. Speakers with diaphragms which delaminate randomly are subject to large variations in operating characteristics and reduced yield of operational speakers.

The invention reduces the local shear stress due to differential thermal expansion and allows for higher conductor temperatures and hence increased power handling. Prior art inventions increased the maximum operating power in electroacoustic speakers by alternative methods including improved heat dissipation from the conductors on the diaphragm. These magnetic acoustic transducers using the prior art alternative designs have limitations in sound reproduction characteristics. U.S. Pat. No. 4,281,223 to Ugaji et al, discloses two heat-resistant vibratory structures for a ribbon type tweeter. In the first, a heat-resistant film containing polyimide is coated on the conductor-diaphragm surface and by improved chemical adhesion to the conductor increases heat conduction from the conductors. However, the diaphragm thickness is approximately doubled compared to typical Mylar™-aluminum diaphragms. Due to the added mass, this method is suited to a miniature tweeter-type planar magnetic transducer, but in larger mid-range planar magnetic transducers there is reduced efficiency due to the increased mass of the diaphragm. Another structure shows use of the heat-resistant coating itself as the substrate portion of the diaphragm; however, the complicated procedure and long processing time is not suited to mass production. The U.S. Pat. No. 4,264,789 to Kaizu et al, discloses a metallic plate or layer at the circumferential portions of the diaphragm and spaced within 100 um for the purpose of heat conduction from the voice coil. This extra layer adds mass and decreases efficiency of the transducer. For diaphragm circuits using vapor-deposited aluminum voice coils, it is difficult to produce suitable conductor thicknesses for optimum electrical characteristics and these circuits are limited in power-handling capability.

Hence, the known methods of increasing the maximum electrical power rating of a planar magnetic transducer have the limitations of reduced efficiency, and slow, costly processing.

While the diaphragm of the magnetic transducer examples described previously are substantially planar, this need not be the case as the diaphragm could also be curved. Also, the invention is not limited to use with small planar magnetic transducers as the invention could be useful in larger planar magnetic transducers.

SUMMARY OF THE INVENTION

The shortcomings of the prior magnetic acoustic transducers, particularly audible distortion and limited power handling of small magnetic loudspeakers, are overcome with the present invention.

It is an object of the present invention to provide improved maximum electrical power rating of small magnetic acoustic transducers, enabling them to be suitable for uses not previously known in the technology.

It is also an object of the invention to provide magnetic acoustic transducers with enhanced sound reproduction characteristics, particularly reduced audible distortion and increased maximum sound pressure level by incorporating diaphragms having the attachment of the conductor runs interrupted to give a conductor-diaphragm structure of optimal thermal stress relief, which permits operation with increased conductor temperature. Hence, when power is applied to the conductor runs the expansion of the conductor at the thermal relief site results in a reduction of distortion of the diaphragm so as to create a more uniform displacement of the diaphragm during operation.

It is a further object of the invention to provide a magnetic acoustic transducer which can operate with a larger variation in diaphragm tension as the thermal stress relief sites on the diaphragm allow a pattern of thermal strain relief without substantially deforming the underlying diaphragm material. Hence the invention is suitable for economical manufacturing.

Magnetic acoustic transducers generally utilize a thin polymer diaphragm having elongated electrical conductor strips mounted thereon, and the present invention is relevant to creating a pattern of thermal stress relief sites along the strips. At each such site, the conductor is not adhered directly to the diaphragm. The meaning of the term adhering as used in the specifications and claims of this application, includes adhesive methods as well as other methods of securing the conductor. The stress relief sites can be created either prior to the diaphragm being stretched and fixed on the support frame of the transducer or produced after the diaphragm is installed into the frame. One or more magnets are mounted so as to be in proximity but spaced from the diaphragm on one or both sides, creating a static magnetic field that interacts with electric current in the conductors such that the resulting force vibrates the diaphragm with piston-like motion to accurately reproduce acoustic signals. As the electrical power in the conductors is increased, the temperature of the conductors is increased, and the induced stress due to differential thermal expansion between the conductor and diaphragm is reduced as the conductor expands at the thermal stress relief sites. The sound reproduction characteristics of the magnetic acoustic transducer are maintained at increased electrical power since resulting changes in diaphragm tension are reduced.

It should be noted that in some of the embodiments the conductor will remain bonded to the diaphragm until sufficient electrical power is applied to the transducer, at which point, the weakened bond at the thermal stress relief sites will allow the heated conductor to expand away from the diaphragm surface. To achieve maximum effectiveness, an array of thermal stress relief sites may be located in a spaced pattern to reduce changes in diaphragm tension across the active area of the diaphragm. A conductor circuit is selectively adhered to the diaphragm such that upon application of electrical power, selected portions of the conductor circuit will expand and separate from the diaphragm in a controllable process, typically forming a miniature arch shape.

The preferred embodiments involve the modification of the adhesion strength of the adhesive layer between the diaphragm material and the conductor foil, so as to make the conductor separable from the diaphragm where the adhesive is weakened. In this application, separable is meant to include all variants from partial separation using an alternate material to full separation of the conductor. The heating of the conductor will cause the conductor to expand and separate from the diaphragm at the weakened adhesive portion. In the most preferred embodiment, a continuous sheet of relatively strong primary adhesive is first laminated to the conductor foil. A secondary material is then applied on the surface of the primary adhesive prior to the lamination with the diaphragm material, to space the conductor from the diaphragm. The secondary material could be an adhesive such that the final laminate has the property of a selectively weakened bond between the conductor and the diaphragm corresponding to the location of the secondary material. In an alternate embodiment, the secondary material could be interleaved with the primary material rather than applied over the surface of the primary adhesive. This interleaving creates a pattern of stronger and weaker bonds across the diaphragm. In either of these two embodiments, conventional circuit etching techniques may be used to form the conductor runs. In addition, the secondary material could be removed entirely, leaving a void space between the conductor layer and the diaphragm, if special precautions are taken to ensure that the conductor adjacent to the void space is not damaged by the etchant.

A further embodiment involves the selective modification of the adhesion strength of the primary adhesive after it has been applied to the conductor foil. For example, chemical means, radiation, or direct heating could be used to selectively weaken the adhesive in a spaced pattern across the diaphragm, and could be done either before or after the conductors are etched.

In another embodiment, a die- or kiss-cut could be used to form the conductors, either by cutting individual conductor strips or by cutting the entire pattern into a foil sheet. The strips or the pattern could then be laminated to the diaphragm material. The methods described in the previous section, such as the application of a secondary material or selective modification of the adhesive strength, could be used in conjunction with this processing technique to create portions of weakened adhesion strength.

In a further embodiment, lightweight ribs could be placed transversely on the diaphragm prior to the lamination of the conductor pattern such that the conductors are spaced away from the diaphragm where they cross the ribs. This configuration is useful because no modification to the adhesive layer is required and the vertical excursion of the conductor during operation is minimized. This physical configuration can also be achieved by laminating a continuous sheet of adhesively-backed conductor foil to a ribbed diaphragm and using an etching process to form the conductors, so long as special precautions are taken to ensure that the etchant does not damage the underside of the aluminum conductors where the conductors pass over the ribs. An etch-resistant adhesive or an etch-resist layer between the conductor and the adhesive may be required.

In a final embodiment, the conductor foil could be mechanically deformed before it is applied to the diaphragm to create a pattern of stress-relief sites. In this embodiment the adhesive is not modified, rather, a pattern of vertical pleats or folds is created which allows the conductors to expand without inducing shear stresses across the surface of the diaphragm.

The preferred embodiment, selectively creating weaker bonds between the conductor and the diaphragm, is the most economical and easy to manufacture. In addition, the density of thermal stress relief sites can be increased with a corresponding reduction in the cross sectional height of the expanded conductor portion such that the cross sectional profile of the diaphragm is negligible.

DESCRIPTION OF THE PREFERRED EMBODIMENT

The preferred embodiment relates to various forms of the conductor on the diaphragm of an acoustic transducer, for the purpose of relieving thermal stresses that may cause undesirable effects. As the size of a planar magnetic transducer is reduced, precise and uniform tensioning of the diaphragm is required to prevent audible distortion. As electrical power is increased, there is a buildup of heat in the conductor runs, and the differential thermal expansion between the conductor layer and diaphragm results in shear stresses between the two layers. The non-uniformity of stress across the diaphragm may result in changes in diaphragm tension and increased audible distortion. It has been determined that the attachment of the conductor runs within the active area of the diaphragm should be interrupted in a spaced pattern, in order to both predefine a path for thermal expansion of the diaphragm due to the heating of the conductor runs as well as to prevent loss of diaphragm tension. The preferred embodiment is related in terms of a planar magnetic loudspeaker with thermal stress relief of the conductor pattern on the diaphragm, and the resulting operation is described with respect to the transducer and diaphragm embodiments depicted in the figures.

Figure 1:
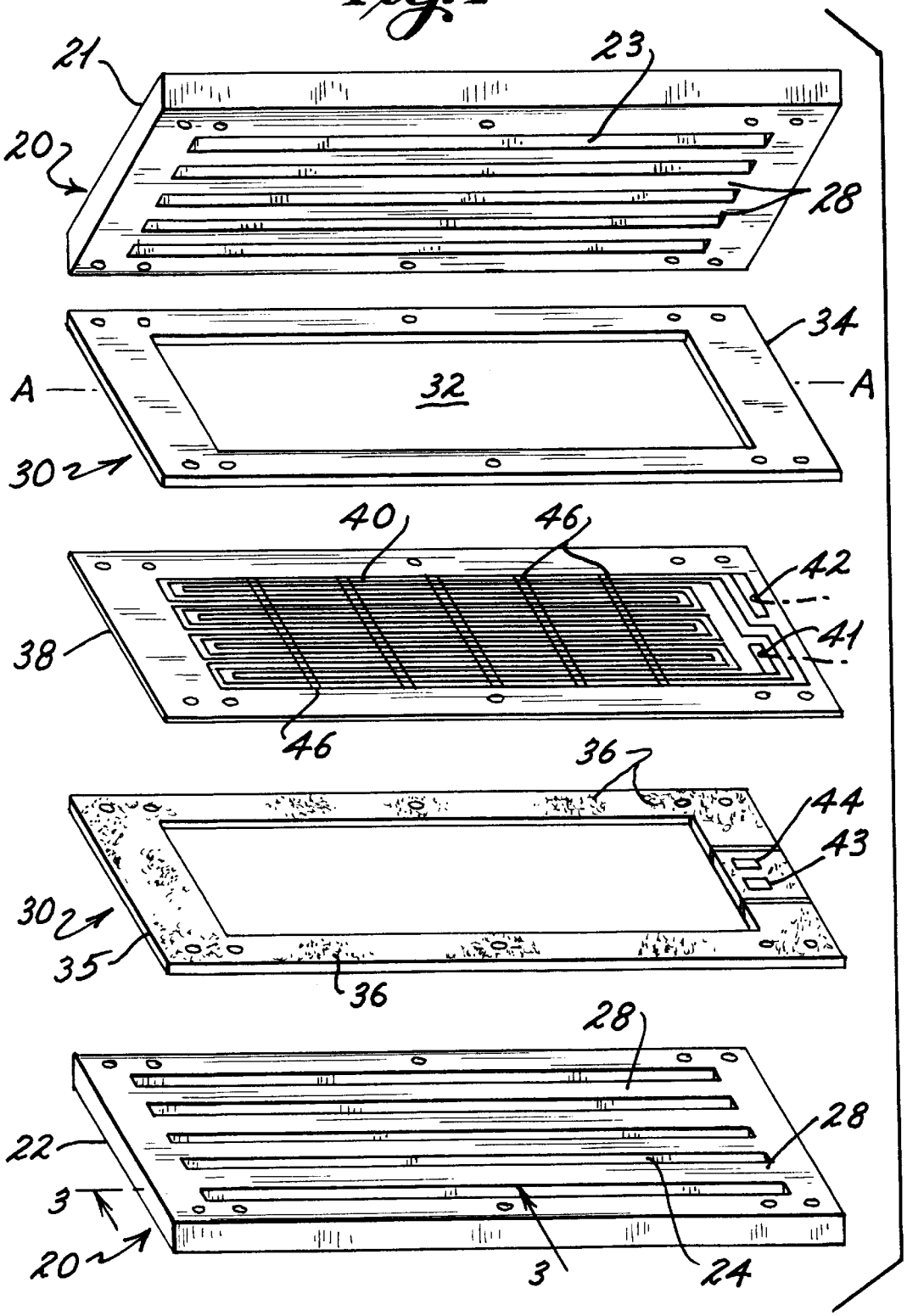
FIG. 1 is a perspective assembly view of a planar magnetic transducer incorporating the improvements of the present invention and showing one embodiment incorporating spacer ribs extending between the electrical conductor runs and the diaphragm.

A planar magnetic transducer utilized as a loudspeaker of the push-pull type is shown in an exploded view, in FIG. 1. The transducer includes an outer frame 20 having opposing frame sections 21 and 22, each of which defines a general open central area 23 and 24, respectively. The frame sections are preferably formed of metal such as steel or similar material. One or more magnets 28 are fixedly mounted in spaced relationship with respect to one another to each of the frame sections and extend from the inside surface of each frame section and across the open central areas. In the embodiment disclosed, the permanent magnets 28 extend generally parallel to a longitudinal central axis "A—A" of the outer frame sections.

Figure 3:
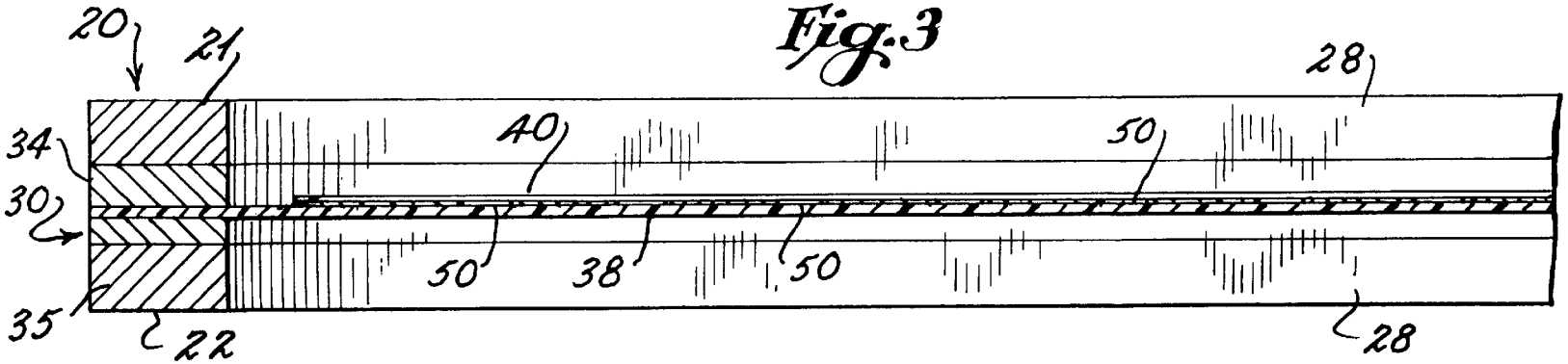
FIG. 3 is an enlarged partial cross-sectional view taken along line A—A of the assembled transducer of FIG. 1; except showing the diaphragm of FIG. 2.

Mounted intermediate between the outer frame sections 21 and 22 is an inner speaker diaphragm frame 30 constructed of steel, as in FIG. 3. The inner frame consists of opposing frame sections 34 and 35 between which a flexible diaphragm 38 is adhered under tension. The inner frame defines an open area 32. When assembled, the diaphragm is retained with in-plane tension between the inner frame sections 34 and 35 by use of suitable securing methods such as adhesives 36. The frame sections may be further adhered by the use of mechanical fasteners as necessary. The diaphragm is formed of a thin flexible plastic material, such as Mylar™ approximately one mil thick, but other materials known in the art such as paper or fabric may be substituted with similar results. In particular, heat-resistant diaphragm materials such as Kapton™ are suited for increased power handling and conductor temperature.

Figure 2:
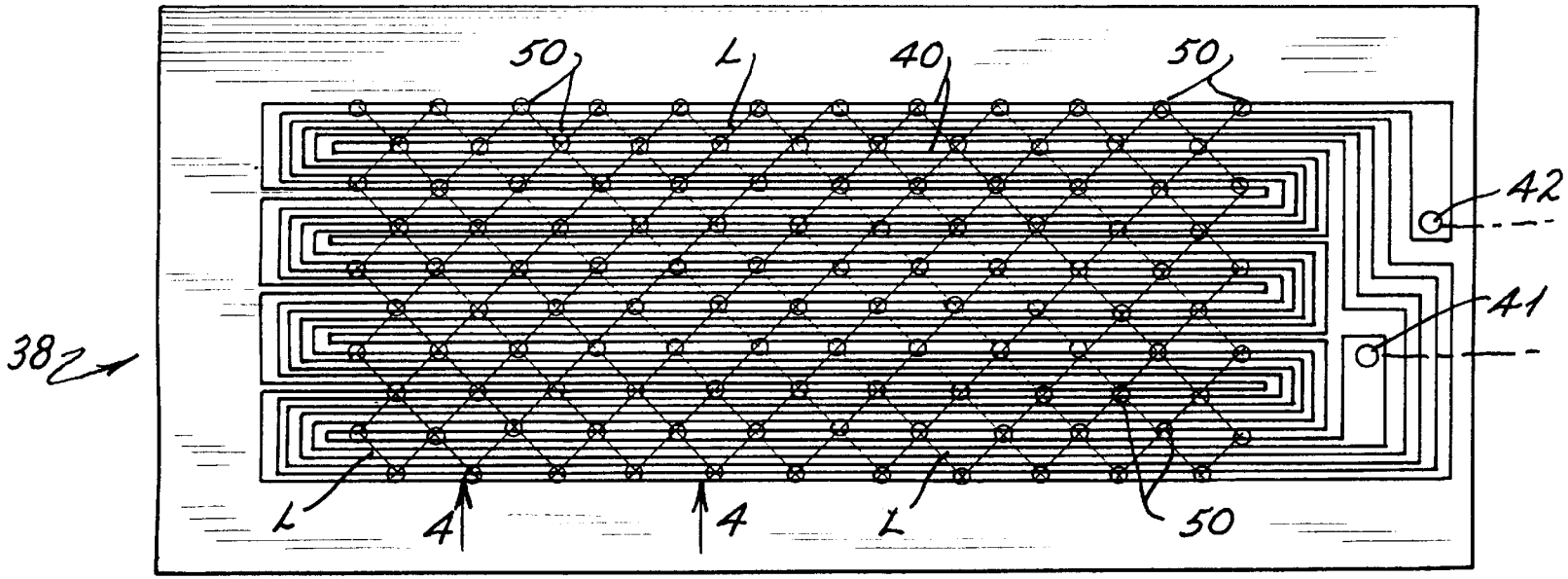
FIG. 2 is a top plan view of another embodiment of the diaphragm shown in FIG. 1; and illustrates spaced portions at which the electrical conductor is not adhered to the underlying diaphragm and wherein the lines connecting the spaced areas are shown to illustrate one type of pattern which could be used.

Another embodiment of the transducer diaphragm is detailed in FIG. 2. One surface of the diaphragm is provided with a "voice coil" pattern consisting of generally parallel runs of an electrical conductor 40. As shown in the preferred embodiment, the conductor runs are oriented generally parallel with respect to the permanent magnets retained on the outer frame sections 21 and 22. The conductor runs are connected at 41 and 42 to positive and negative terminals 43 and 44 of the frame section 35 which are designed to be electrically connected to a suitable amplifier (not shown). The conductor runs 40 are preferably formed of aluminum or clad-aluminum. The conductor runs are shown as being generally rectangular in configuration; however, the runs along the surface of the diaphragm may take a variety of forms including round or oval. The conductors are typically bonded to the diaphragm as a foil laminate and then the conductor circuit pattern, as determined by the magnet placement, is etched. The conductor dimensions, compositions, and circuit arrangements are chosen to meet desired circuit impedance requirements and provide maximum efficiency within practical limitations. The aluminum and clad-aluminum conductors are preferred due to their lower mass and overall lower mass-resistivity compared to other conductors. A lower mass diaphragm has the advantage of allowing for fast transient response and lower mass-resistivity equates to higher transducer efficiency.

The diaphragm 38 of the transducer is attached in a precise manner for optimum sound reproduction. The diaphragm 38 having the conductor runs 40 thereon, is aligned and mounted within the inner frame 30 and is normally tensioned, stretched, or held in a taut configuration in a plane parallel to the pole faces of the permanent magnets 28. The diaphragm is spaced generally equidistant between the permanent magnets on either side thereof. The "active area" 45 of the diaphragm is that area of the diaphragm which is not constrained from motion by the rigid frame 30. Following proper alignment of the diaphragm to the rigid frame 30, the conductor runs 40 generally extend in proximity to the edges of the permanent magnets. The path of the conductors on the diaphragm is generally chosen so that the current flowing through the conductor runs induces net forces of uniform direction for all of the conductor segments or runs across the active area thereby causing the general direction of the diaphragm motion to be perpendicular to the diaphragm surface.

The interruption of the attachment of the conductor runs to create thermal stress relief sites is illustrated through various embodiments. One embodiment of the invention is shown in FIG. 2, where the diaphragm 38 is shown with thermal stress relief sites illustrated by small circles at 50, with a possible example of the pattern of sites shown for illustrative purposes. Typically, a higher density of thermal stress relief sites than illustrated would be preferable. The conductor circuit is selectively bonded to the diaphragm so that upon application of electrical power, selected portions of the conductor will expand and lift from the diaphragm in a controlled process, forming a miniature arch shape as shown in cross-section in FIG. 6. In addition, the density of non-adhered areas can be increased with a corresponding reduction in the length of each portion such that the height of the conductor arch 52 is minimized during operation. In FIG. 3, the height of the thermal stress relief sites is shown to be negligible relative to the gap between opposing magnets. The selective bonding of the conductor to the diaphragm can be accomplished using various methods and the preferred method is to selectively modify the conductor adhesion to the diaphragm at spaced sites. The preferred embodiments are to laminate the conductor film to a polymer diaphragm and then to etch the conductor pattern, using techniques well known in the art. Alternative non-etched embodiments are also described.

Figure 4:
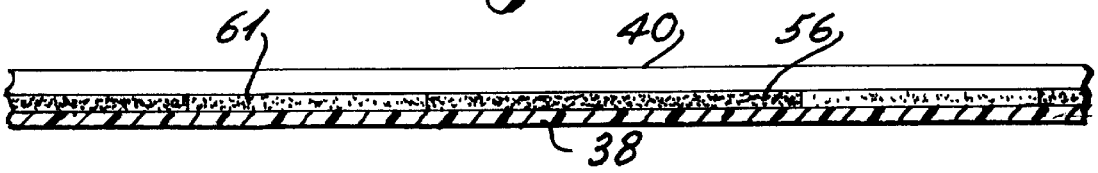
FIG. 4 is an enlarged partial cross sectional view of the diaphragm of FIG. 2 with composite adhesive layer.
Figure 9:
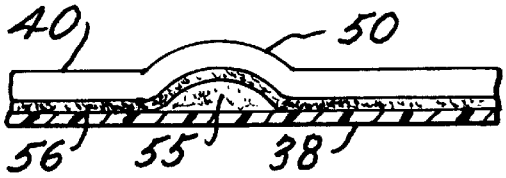
FIG. 9 is an enlarged partial cross sectional view of the structure in FIG. 10 following application of power to the conductor.
Figure 10:
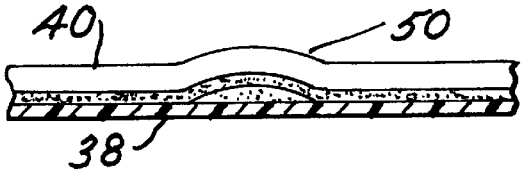
FIG. 10 depicts another alternate embodiment for which a second adhesive is selectively bonded to the diaphragm under the conductor.

In FIG. 2, the density and pattern of the non-adhered areas is further illustrated by lines "L" which are shown for clarification only and do not actually appear on the diaphragm. The preferred embodiment is represented in FIG. 10, where segments of material 55 are selectively added to the diaphragm, prior to lamination with typical conductor layer 40 having adhesive backing 56. This material may be a secondary adhesive, or alternative material such as etch resist or inert liquid. The adhesive backing on the conductor layer is shown at 56. The preferred secondary adhesive 55 has properties of significantly lower adhesion strength than the conductor layer adhesive 56, and is thick enough to substantially stay localized during the lamination of the metal foil. The application of the secondary adhesive can be done precisely with automated dispensers, with the diaphragm held taut. The material 55 could also be deposited on the conductor adhesive 56. The assembled diaphragm with metal foil then has a pattern of sites which are bonded with less strength than the directly adhered sites. In FIG. 9, the structure in FIG. 10 is shown after power is applied to the circuit as the non-contacted conductor segment 50 expands away from the diaphragm and sets in an miniature arch, providing thermal stress relief. A further embodiment involves interleaving two adhesives onto the conductor foil so that the composite adhesive layer is of uniform thickness, but with varying adhesion of the conductor to the diaphragm at controlled thermal stress relief sites. The laminate with two adhesive types 56 and 61, is shown in FIG. 4 as an example typical of a rolling type application of the two adhesives which would result in a conductor laminate with uniform thickness with selectively located portions of the adhesive 61 with the weaker bond. The advantage of using the above methods for applying a continuous layer of two adhesive types is the ability to use conventional etching techniques to produce the conductor pattern.

Figure 5:
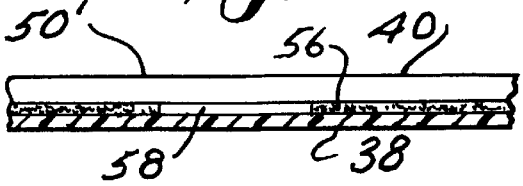
FIG. 5 is an enlarged partial cross sectional view of a non-adhered site taken along line 5—5 of FIG. 2.
Figure 6:
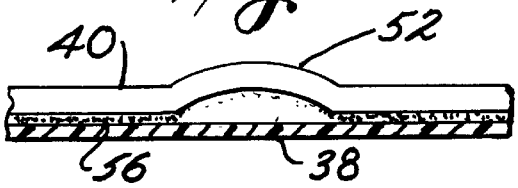
FIG. 6 is an enlarged partial cross sectional view of the structure in FIG. 5 following application of power to the conductor.

An alternative embodiment has the weakened adhesive removed entirely, leaving voids 58 underneath the conductor, as shown in FIG. 5. Following application of power to this embodiment with voids under the conductor, the non-contacted segments 50' expand and set in a miniature arch 52 as shown in FIG. 6, and hence provide thermal stress relief.

Figure 7:
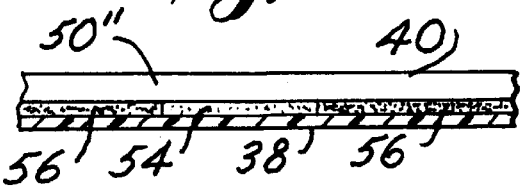
FIG. 7 is an enlarged partial cross section of a conductor layer with weakened adhesive site.
Figure 8:
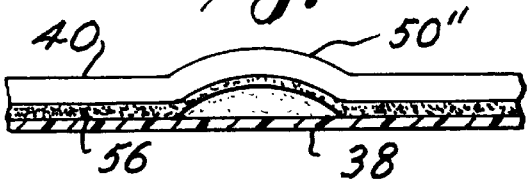
FIG. 8 is an enlarged partial cross sectional view of the structure in FIG. 7 following application of power to the conductor.

A variation on the weakly adhered bond is shown in FIG. 7, where the conductor segment 50" at the non-adhered site has adhesive portion 54 that is processed to have weaker bond strength than the primary laminate backing adhesive 56. As the adhesive at this selected thermal stress relief site has a significantly weakened bond strength, heating of the conductor from application of electrical power will expand the metal foil and separate the conductor from the diaphragm as shown in FIG. 8. The local weakened bond may be created by processing the adhesive backed metal foil prior to lamination of the conductor foil with the diaphragm. The processing could include modifying the adhesive bonding properties by thermal, optical, chemical, or mechanical means, dependent on the degree of localization required and the composition of the adhesive layer. Conversely, the surface of the diaphragm could be pretreated chemically such that the adhesion strength is selective. There are additional etched-type embodiments with the adhesive properties modified after lamination of the conductor layer and even after etching of the conductor run pattern. For example, focusing of optical radiation through the diaphragm to the adhesive could be used to modify the adhesive properties locally. In addition, localized heating of the top of the conductor layer at selected sites may be used to modify the adhesive properties. Further, a chemical treatment could be selectively applied to weaken the adhesive layer 56 by localized dissolving or otherwise modifying the adhesion strength of the bond between the conductor and the substrate.

Alternative embodiments that don't utilize an etching process include die-cutting a conductor web pattern from the conductor film and then laminating to the diaphragm polymer, or individual die-cutting of strips that are bonded to the diaphragm and interconnected in the conductor pattern at the edges of the diaphragm. Both of these non-etched embodiments can incorporate the preceding concepts for selectively non-adhered segments of the conductor runs.

Figure 11:
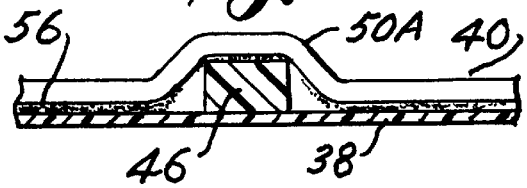
FIG. 11 is an enlarged partial cross-section of the diaphragm shown in FIG. 1 showing a conductor layer with a thin rib structure.
Figure 12:
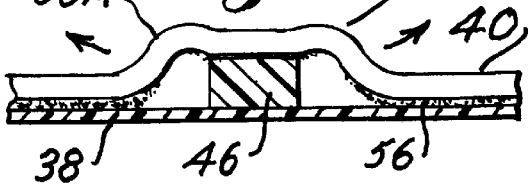
FIG. 12 is an enlarged partial cross sectional view of the structure in FIG. 11 following application of power to the conductor.

An alternate embodiment incorporates a thin rib structure underneath the conductor and is shown in FIG. 11. The forming of the conductor runs could be either through the etching process or the non-etched processes mentioned above. A plurality of flat spacer ribs 46 are attached to the diaphragm in a pattern which extends generally perpendicularly across the active area 45 of the diaphragm 38 and underneath the conductor runs 40, as shown in FIG. 1. The spacer ribs are slim in profile and lightweight, a polymer plastic or foam are suitable, and the rib may have adhesive backing for attachment. Typically the spacer ribs would be attached when the diaphragm is maintained in a wrinkle free flat or taut state so the ribs are fully adhered to the diaphragm. The size and configuration of the spacer ribs may vary depending upon the application of the transducer. The conductor runs are then applied over the spacer ribs, and may be shaped over the ribs. It is preferred that the conductor runs be applied uniformly with minimal wrinkles. One method is to apply an adhesively-backed layer of aluminum over the diaphragm with spacer ribs, and then chemically etch the desired conductor runs. To prevent the etching solvent from etching at the gaps underneath the conductor at the rib, an ultrathin resist coating (not shown) can be applied to the underside of the conductor film. In FIG. 12, the structure in FIG. 11 is shown after power is applied to the circuit, the non-contacted conductor segments 50A expands away from the diaphragm 38 but it expands more to the side than away from the diaphragm surface.

As a final embodiment, the conductor foil may be mechanically deformed either prior to its attachment to the diaphragm material, or after the final conductor pattern has been formed. The deformation could take the form of a spaced array of vertical folds or pleats. The individually die-cut strips may be mechanically deformed prior to bonding to the diaphragm, to form the thermal stress relief. Such mechanical deformation could include selective crimping or embossing of the conductor foil or strips prior to bonding to the diaphragm.

The improved operation of the planar magnetic transducer with thermal stress relief sites at the conductors will now be described. After the diaphragm with delaminated conductor sites is formed, it is placed within an appropriate frame and the frame is manipulated to stretch the diaphragm generally uniformly in all directions so that equal tension is applied throughout the diaphragm. With the diaphragm pulled taut, the diaphragm is placed within the inner frame sections 34 and 35 and adhered between the frame sections as they are joined to one another to thereby retain the diaphragm in proper tension. The areas of the active area with non-adhered or weakly adhered conductor segments will function to maintain uniform tension and reduce wrinkling of the diaphragm during operation as such segments expand and contract. As electrical power is increased, there is a buildup of heat in the conductor runs, and the differential thermal expansion between the conductor layer and diaphragm results in shear stresses between the two layers. In a conventional diaphragm, the non-uniformity of stress across the diaphragm may result in changes in diaphragm tension and increased audible distortion. The thermal stress relief sites detailed in this disclosure both predefine a path for thermal expansion of the diaphragm due to the heating of the conductor runs as well as reduce the change of diaphragm tension. The above process increases the maximum sustainable output of the smaller planar magnetic transducers by as much as 5 to 10 dB. Such thermal stress relief also reduces the need for precise tensioning of the diaphragm within the inner frame.

In view of the foregoing embodiments, the selective stress relief of the conductor runs across the active area of the diaphragm is beneficial in order to prevent change in tension in the diaphragm during operation of the transducer and hence provide more uniform motion of the diaphragm. The configuration and density of the delamination zones may take various forms depending on the particular output and operating requirements of a particular transducer.

Although the preferred embodiment is shown incorporating a generally rectangular diaphragm, the diaphragm may take other configurations, including circular or oval configurations. Likewise, the conductor runs may be applied to the active area of the diaphragm in other patterns, including circular or oval patterns, and remain within the teachings of the present invention.

Although the preferred embodiment discloses thermal stress relief sites of conductor runs across the active area of the diaphragm, in some instances it may be desired to selectively treat only portions of the surface of the diaphragm and/or the surface areas of the conductors. It is possible to selectively delaminate or otherwise weakly adhere only portions or segments of the conductor runs which extend along underlying portions of the diaphragm. Such selective delamination should be oriented transversely and preferably perpendicularly across the surface of the conductor runs. As with all previous embodiments, the density and pattern of the delaminations may also vary depending on the position of the conductor runs relative to the borders of the diaphragm.

The planar magnetic transducer described has the benefits of increased power handling in small transducer geometries, reduced distortion levels, smoother frequency response, and controllable diaphragm behavior with increased power. The foregoing description of the preferred embodiment of the invention has been presented to illustrate the principles of the invention and not to limit the invention to the particular embodiment illustrated. It is intended that the scope of the invention be defined by all the embodiments encompassed within the following claims and their equivalents, in particular variations and combinations of the invention which are obvious to one skilled in the art.

We claim:

1. In an acoustic transducer including;

a frame, a diaphragm adhered to said frame and having an active area under tension spaced inside said frame, an electrical conductor means adhered to portions of a surface of said active area of said diaphragm, and at least one magnet means mounted so as to be spaced from said diaphragm;

the improvement comprising:

said electrical conductor means is formed as a conductor layer that is adhered with an adhesive layer onto said diaphragm, and at least one segment of said electrical conductor means being selectively separable from said portions of said diaphragm.

2. The acoustic transducer of claim 1 wherein a material is selectively provided on said portions of said surface underlying said at least one segment of said conductor means, such that said at least one segment of said conductor means is spaced from said portions of said diaphragm.

3. The acoustic transducer of claim 2, including a plurality of segments of said conductor means being selectively separable from said portions of said surface of said active area of said diaphragm in a spaced arrangement with respect to one another.

4. The acoustic transducer of claim 2 wherein said material is a second adhesive.

5. The acoustic transducer of claim 4 wherein said adhesive layer is selectively treated at said at least one segment of said conductor means, to reduce the bond strength such that said at least one segment is non-adhered to said diaphragm upon the application of electrical power to said electrical conductor.

6. The acoustic transducer of claim 5 wherein said adhesive layer at said at least one segment of said conductor means is modified in bond strength by exposure to electromagnetic radiation.

7. The acoustic transducer of claim 5 wherein said adhesive layer at said at least one segment of said conductor means is modified in bond strength by local heating at said at least one segment of said conductor means.

8. The acoustic transducer of claim 5 wherein said adhesive layer at said at least one segment of said conductor means is modified in bond strength by chemical processing at said at least one segment of said conductor means.

9. The acoustic transducer of claim 4, including a plurality of segments of said conductor means being selectively separable from said portions of said surface of said active area of said diaphragm in a spaced arrangement relative to one another.

10. The acoustic transducer of claim 4, wherein said transducer is a planar magnetic transducer.

11. The acoustic transducer of claim 1 wherein said adhesive layer is formed by selective application of two adhesive types underlying said conductor layer, one of said adhesive types having a weaker bond strength than the other type, such that said at least one segment of said electrical conductor means is non-adhered when electrical power is applied to said conductor layer.

12. The acoustic transducer of claim 1 wherein said at least said one segment of said electrical conductor means is formed by selective application of the adhesive layer to spaced portions of said surface of said active area of said diaphragm.

13. The acoustic transducer of claim 1 wherein at least said one segment of said electrical conductor means is formed by selective removal of the adhesive layer underlying said at least one segment of said conductor layer.

14. The acoustic transducer of claim 13, wherein a material is selectively provided on said portions of said surface of said active area of said diaphragm such that said at least one segment of said conductor means is spaced from said portions of surface of said active area of said diaphragm.

15. The acoustic transducer of claim 13, wherein said at least one segment of said electrical conductor means is selectively deformed to be separable from said diaphragm.

16. The acoustic transducer of claim 1 wherein said electrical conductor means is mechanically formed as conductor strips that are adhered with said adhesive layer onto said diaphragm.

17. The acoustic transducer of claim 1 wherein said diaphragm is curved.

18. A planar magnetic transducer including;

a frame, a diaphragm supported by said frame and having an active area under tension spaced inside of said frame, an electrical conductor layer applied by an adhesive layer so as to be adhered to portions of said active area of said diaphragm, at least one magnet means mounted so as to be spaced from said diaphragm; and at least one segment of said electrical conductor layer being separable from said portions of said active area of said diaphragm by at least one spacer means positioned between said at least one segment of said conductor layer and said portions of said active area of said diaphragm.

19. The planar magnetic transducer of claim 18 wherein said conductor layer is applied to said portions of said active surface area so as to define a plurality of substantially parallel rows, said at least one spacer means being a spacer rib extending substantially transversely with respect to said rows across said active area of said diaphragm, and said at least one segment of said electrical conductor layer being adhered to the diaphragm spaced from said spacer rib.

20. The planar magnetic transducer of claim 19 wherein said at least one segment is formed to provide air gaps at opposite edges of said spacer rib so that said at least one segment can expand laterally relative to said portions of said active surface area of said diaphragm.

* * * * *